United States Patent [19]

Miller

[11] Patent Number: 4,784,323

[45] Date of Patent: Nov. 15, 1988

[54] ELECTROMAGNETIC ATOMIZER

[75] Inventor: James K. Miller, Cass City, Mich.

[73] Assignee: Walbro Corporation, Cass City, Mich.

[21] Appl. No.: 74,639

[22] Filed: Jul. 17, 1987

[51] Int. Cl.[4] ..... B05B 3/14; B05B 1/26

[52] U.S. Cl. ..... 239/102.2; 239/502; 310/323; 74/155; 123/590

[58] Field of Search ..... 239/102.2, 500, 502; 310/323; 74/155; 123/590; 346/75

[56] References Cited

U.S. PATENT DOCUMENTS

| | | | |
|---|---|---|---|
| 3,666,975 | 5/1972 | Balamuth | 310/323 |
| 3,683,396 | 8/1972 | Keur et al. | 346/75 X |
| 3,979,756 | 9/1976 | Helinski et al. | 239/102.2 X |
| 4,210,920 | 7/1980 | Burnett et al. | 346/75 |

FOREIGN PATENT DOCUMENTS

| | | | |
|---|---|---|---|
| 676330 | 8/1979 | U.S.S.R. | 239/102.2 |

*Primary Examiner*—Andres Kashnikow
*Assistant Examiner*—Mary Beth O. Jones
*Attorney, Agent, or Firm*—Barnes, Kisselle, Raisch, Choate, Whittemore & Hulbert

[57] ABSTRACT

An electromagnetic fuel atomizer for internal combustion engine applications which includes a generally C-shaped core of integral ferromagnetic construction having arms which form a pair of flat parallel surfaces spaced from each other to form a gap therebetween. The core structure is characterized by a fundamental resonant frequency determined in part by mass and elasticity of the core structure, and the ferromagnetic core is electromagnetically energized at such fundamental resonant frequency. Liquid fuel is supplied to the gap between the core arm surfaces, and standing waves are generated therein as the core arms vibrate with respect to each other. As amplitude of oscillations and such standing waves increase, fuel droplets break away from the standing wave nodes and are aspirated into the engine.

5 Claims, 1 Drawing Sheet

ELECTROMAGNETIC ATOMIZER

The present invention is directed to devices for atomizing liquid, and more particularly to a fuel atomizer for internal combustion engines.

In an effort to eliminate rough idle and other problems caused in part by poor fuel distribution and carburization in internal combustion engines, it has been proposed to atomize the fuel as part of the carburization process. Conventional piezoelectric atomizers, although efficient in atomizing liquid fuel into a fine mist, are expensive in implementation. An object of the present inventions to provide a liquid atomizer for internal combustion engine applications which atomizes fuel sufficiently to overcome rough idle and other related carburization problems, and yet is inexpensive to implement and maintain.

A more general object of the present invention is to provide a liquid atomizer which operates upon electromagnetic resonant frequency principles and which is inexpensive to manufacture and operate.

Figure 1:
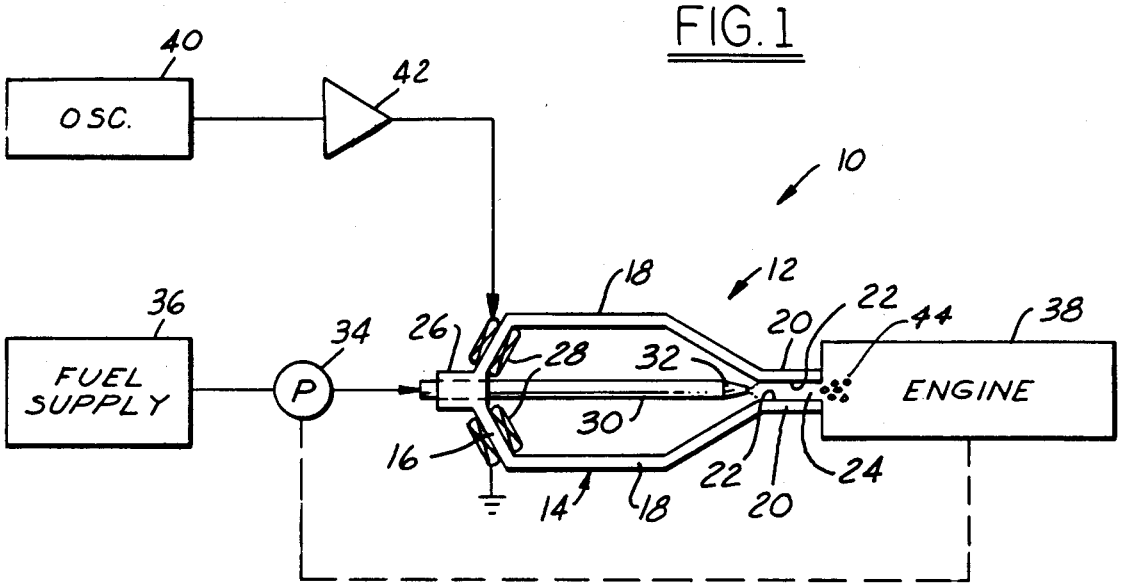
Figure 2:
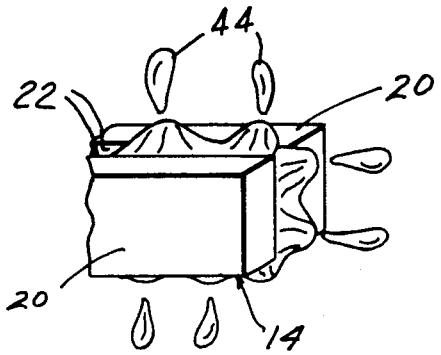

The invention, together with additional objects, features and advantages thereof, will be best understood from the following description, the appended claims and the accompanying drawing in which:

FIG. 1 is a functional block diagram of an engine fuel atomization system which includes an electromagnetic atomizer in accordance with a presently preferred embodiment of the invention; and FIG. 2 is a fragmentary perspective view on an enlarged scale which illustrates principles of operation of the atomizer of FIG. 1.

FIG. 1 illustrates an atomization system 10 which includes an electromagnetic atomizer 12 in accordance with a presently preferred embodiment of the invention. Atomizer 12 comprises a generally C-shaped or horeshoe-shaped core 14 of integral ferromagnetic construction. Core 14 has a base 16 with a pair of parallel arms 18 projecting from opposite ends thereof and terminating in opposed plates 20 having flat parallel surfaces 22 spaced from each other by a gap 24. Core 14 has an axis of bilateral symmetry which extends centrally through base 16 and through gap 24. A hollow boss 26 integrally projects from base 16 oppositely of and in axial alignment with gap 24—i.e., coaxially with the axis of bilateral symmetry. A pair of electromagnetic coils 28 surround legs of base 16 on opposite sides of boss 26. It will be noted in FIG. 1 that such legs of base 16 are angulated with respect to each other. Coils 28 are connected in series such that current in a given direction therethrough generates additive rather than opposed magnetic fields.

A tube 30 extends axially through boss 26 along the axis of symmetry and terminates in a nozzle 32 adjacent to gap 24 internally of core 14. A pump 34 feeds fluid from a fuel supply 36 to the end of tube 30 adjacent to boss 26, and is coupled to engine 38 for feeding fuel through tube 30 at a rate which varies as a function of engine speed. An oscillator 40 electronically drives coils 28 through an amplifier 42 for electromagnetically energizing core 14 and thereby vibrating arms 18 and plates 20 with respect to each other. More specifically, current in a given direction generates magnetic flux in core 12 which bridges gap 24 between arm end plates 20 and thereby draws plates 20 toward each other. When such current is terminated, plates 20 move away from each other due to resiliency of core arms 18.

In accordance with an important and distinguishing feature of the present invention, the mechanical construction of core 14 gives rise to, and is thus characterized by, a fundamental resonant frequency determined by such variables as mass, design and elasticity of the core structure. Oscillator 40 drives coils 28 at such resonant frequency, which most preferably is on the order of 2 kHz. Core 14 thus, in effect, vibrates in the manner of a tuning fork, with arm end plates 20 vibrating toward and away from each other at the core resonant frequency. Pump 34 supplies fuel through tube 30 to gap 24 at a rate sufficient to fill gap 24, which is preferably on the order of 0.010 to 0.015 inch dimension between surfaces 22. Such rate is, of course, determined in part by fuel demand at engine 38, and thus pump 34 is driven as a function of engine speed as previously indicated.

Thus, coil 28 and core 14 are driven at a fixed frequency corresponding to the fundamental resonant frequency of core 14. As plate surfaces 22 vibrate with respect to each other, standing waves illustrated in FIG. 2 are generated around periphery of the liquid fuel captured between surfaces 22 in gap 24. As the amplitude of the standing waves increases, droplets illustrated at 44 break off or become separated from the standing wave modes of liquid fuel reservoir between the core plates. Such fuel droplets are then aspirated into engine 38 in any suitable conventional manner. Particle size of droplets 44 varies as a direct function of fluid surface tension, and as an inverse function or fluid density and core resonant frequency, but does not vary substantially with fluid viscosity.

There is thus provided in electromagnetic fuel atomizer which operates at sonic frequencies and which fully satisfies all of the objects and aims previously set forth. Alternatives and modifications are envisioned. For example, fuel could be delivered to gap 24 through a passage or bore which extends through one of the arms 18. However, such a modification would result in differing masses and elasticities at the respective core arms, thereby eliminating bilateral symmetry previously described and resuling in non-uniform modes of vibration. On the other hand, core bilateral symmetry as in the preferred embodiment illustrated in the drawing insures uniform modes of vibration. As previously noted, excitation at the fundamental resonant frequency of the core structure is critical to proper operation. It is therefore envisioned that feedback techniques may be employed in some applications for controlling excitation frequency against temperature variations, etc.

The invention claimed is:

1. A fuel atomizer for internal combustion engines comprising ferromagnetic structure having a pair of surfaces spaced from each other to form a gap therebetween said ferromagnetic structure being characterized by a fundamental resonant frequency determined in part by mass and elasticity of said structure, means for feeding liquid fuel to said gap at a rate so as to substantially fill said gap with liquid fuel, and means for electromagnetically energizing said ferromagnetic structure at said fundamental resonant frequency for vibrating said structure including said surfaces at said fundamental resonant frequency and developing standing waves in said liquid fuel around the periphery of said gap.

2. The fuel atomizer set forth in claim 1 wherein said ferromagnetic structure has a fundamental resonant frequency of about 2 kHz.

3. The fuel atomizer set forth in claim 1 wherein said fuel-feeding means includes means for feeding fuel at said rate which varies as a function of engine speed.

4. The fuel atomizer set forth in claim 1 wherein said ferromagnetic structure comprises an integral generally C-shaped core of ferromagnetic construction having a base, a pair of arms projecting from said base, said arms terminating in said surfaces, and an electric coil encircling said base.

5. The fuel atomizer set forth in claim 4 wherein separation between said surface is in the range of ten to fifteen thousandths of an inch.

* * * * *